US005204200A

United States Patent [19]

Kobata et al.

[11] Patent Number: 5,204,200

[45] Date of Patent: Apr. 20, 1993

[54] LAMINATED ORGANIC PHOTOSENSITIVE MATERIAL COMPRISING AN X-TYPE NONMETAL PHTHALOCYANINE IN THE CHARGE GENERATING LAYER

[75] Inventors: Tomokazu Kobata; Yosuke Matsui, both of Kobe, Japan

[73] Assignee: Bando Chemical Industries, Ltd., Hyogo, Japan

[21] Appl. No.: 651,444

[22] Filed: Feb. 7, 1991

[30] Foreign Application Priority Data

Feb. 7, 1990 [JP] Japan ..... 2-27958

[51] Int. Cl.[5] ..... G03G 5/10

[52] U.S. Cl. ..... 430/58; 430/78; 430/96

[58] Field of Search ..... 430/58, 59, 60, 78, 430/96

[56] References Cited

U.S. PATENT DOCUMENTS 4,800,144 1/1989 Ueda et al. ..... 430/58

4,877,701 10/1989 Hiro et al. ..... 430/58

*Primary Examiner*—Marion E. Mc Camish

*Assistant Examiner*—S. Rosasco

*Attorney, Agent, or Firm*—Wegner, Cantor, Mueller & Player

[57] ABSTRACT

There is disclosed a laminated organic photosensitive material which comprises an electroconductive support, an undercoat, a charge producing layer and a charge transporting layer in sequence wherein the undercoat is composed of an alcohol soluble polyamide resin and wherein the charge producing layer contains X-type nonmetal phthalocyanine as a charge producing substance and a mixture of a vinyl chloride-etyhylene copolymer in an amount of 40–95% by weight and a vinyl chloride-vinyl acetate-maleic acid copolymer in an amount of 5–60% by weight based on the mixture as a binder resin for the layer.

11 Claims, 2 Drawing Sheets

LAMINATED ORGANIC PHOTOSENSITIVE MATERIAL COMPRISING AN X-TYPE NONMETAL PHTHALOCYANINE IN THE CHARGE GENERATING LAYER

FIELD OF THE INVENTION

This invention relates to a laminated organic photosensitive material which has an undercoat, a charge producing layer and a charge transporting layer formed in sequence on an electroconductive support.

DESCRIPTION OF PRIOR ART

A composite or laminated type organic photosensitive material has been developed and put to practical use in recent years. This type of organic photosensitive material is disclosed in, for example, Japanese Patent Publications Nos. 42380/1980 and 34099/1985. It comprises an electroconductive support, a charge producing layer and a charge transporting layer formed on the support. For instance, such a composite photosensitive material has an electroconductive support of aluminum layer deposited on a polyester film, a charge producing layer formed on the aluminum layer, and a charge transporting layer formed on the charge producing layer.

The charge producing layer is formed by, for example, preparing a dispersion of a charge producing substance together with an organic solvent, a binder resin, and if necessary a plasticizer, applying the dispersion onto the support, and drying to a thin film. The charge transporting layer is formed by, for example, dissolving a charge transporting substance in an organic solvent together with a binder resin, and if required a plasticizer, applying the solution onto the charge producing layer, and drying to a thin film. A charge transporting layer may be first formed on the support, and then a charge producing layer on the charge transporting layer.

It is desirable that the charge producing layer has a thickness of less than about one micron so that the photosensitive material is readily electrified in the dark and has a high photosensitivity. Meanwhile it is generally accepted that copy images produced with a laminated photosensitive material by a reverse developing electrophotographic process often contain image defects such as dark spots or lines thereon.

It is already known that the provision of an undercoat or intermediary layer composed of a resin between the electroconductive support and the charge producing layer to obviate the problem of such image defects. It is necessary that the undercoat prevents the injection of electric charges into the photosensitive material from the electroconductive support so that the photosensitive material is stably electrified thereby to eliminate the defects on the copy images. It is also necessary that residual potential is not accumulated on the material so that the photosensitive material provides clear images after a long term use. Alcohol soluble polyamide resin has been proposed to use as an undercoat resin to meet those requisites, as disclosed in Japanese Patent Publication No. 58-45707 and Japanese Patent Application Laid-open No. 60-168157.

The provision of an undercoat of such a water soluble polyamide resin enables the formation of a thin and even charge producing layer. However, it is also known that the properties of the photosensitive material such as an extent to which the material is electrified or to which residual potential is accumulated, or photosensitivity, are remarkably affected depending upon the electric properties of the undercoat, a charge producing substance and a binder resin used in the charge producing layer. As a result, the image defects are not eliminated satisfactorily, or a high residual potential is remained on the photosentive material if the defects have been eliminated.

Thus a variety of particular combinations of an undercoat of an alcohol soluble polyamide resin and a charge producing layer have been proposed. For example, the use of polyvinyl butyral resin as a binder resin for the charge producing layer is disclosed in Japanese Patent Application Laid-open No. 58-30757, while the use of a phenoxy resin as a binder resin for the charge producing layer is disclosed in Japanese Patent Application Laid-open No. 60-30757. The use of copper phthalocyanine as a charge producing substance is disclosed in Japanese Patent Application Laid-open No. 60-227264.

Although a number of combination of an undercoat of alcohol soluble polyamide resin and a binder resin or a charge producing substance used in the charge producing layer are already known as set forth above, but the resultant photosentive material is still attended by problems that it is unstably electrified or it provides copy images containing undesirable defects such as dart spots or lines. Further, the photosensitive material has a high residual potential and an insufficient adhesion between the layers and of the photosensitive layer to the support.

SUMMARY OF THE INVENTION

It is an object of the invention to provide a laminated organic photosensitive material which is readily and stably electrified in the dark, and residual potential remains low after a long term use, thereby to provides copy images having no defects thereon as hereinbefore mentioned.

In accordance with the invention, there is provided a laminated organic photosensitive material which comprises an electroconductive support, an undercoat, a charge producing layer and a charge transporting layer in sequence wherein the undercoat is composed of an alcohol soluble polyamide resin and wherein the charge producing layer contains X-type nonmetal phthalocyanine as a charge producing substance and a mixture of a vinyl chloride-ethylene copolymer in an amount of 40–95% by weight and a vinyl chloride-vinyl acetate-maleic acid copolymer in an amount of 5–60% by weight based on the mixture as a binder resin for the layer.

DETAILED DESCRIPTION OF THE INVENTION

The alcohol soluble polyamide resin used in the invention is a nylon copolymer as described in Japanese Patent Publication No. 58-45707, and may be exemplified by nylon 6/66, 6/66/610 and 6/66/610/12. These alcohol soluble polyamide resins are commercially available. A further example of alcohol soluble polyamide resin is a chemically modified homonylon such as N-alkoxymethyl modified nylon.

The above mentioned alcohol soluble polyamide resins are soluble in lower aliphatic alcohols such as methanol, ethanol or propanol. The alcohol soluble polyamide resins are therefore dissolved in such an alcohol, and the solution is applied onto the surface of the electroconductive support, heated and dried, to form an undercoat. The undercoat has a thickness preferably of 0.3–5 microns.

The alcohol solution of the polyamide resin may contain, if necessary, an aromatic hydrocarbon such as benzene, toluene or xylene to raise the stability of the solution. The alcohol solution may further contain a small amount of a solvent, if necessary, such as water, trichloroethylene, chloroform, benzyl alcohol, phenol, oxalic acid or acetic acid.

The photosensitive material of the invention has a charge producing layer on the undercoat. The charge producing layer contains X-type nonmetal phthalocyanine as a charge producing substance. The X-type nonmetal phthalocyanine is represented by the formula:

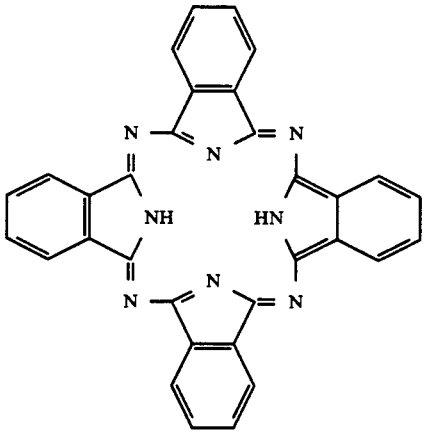

Figure 1:
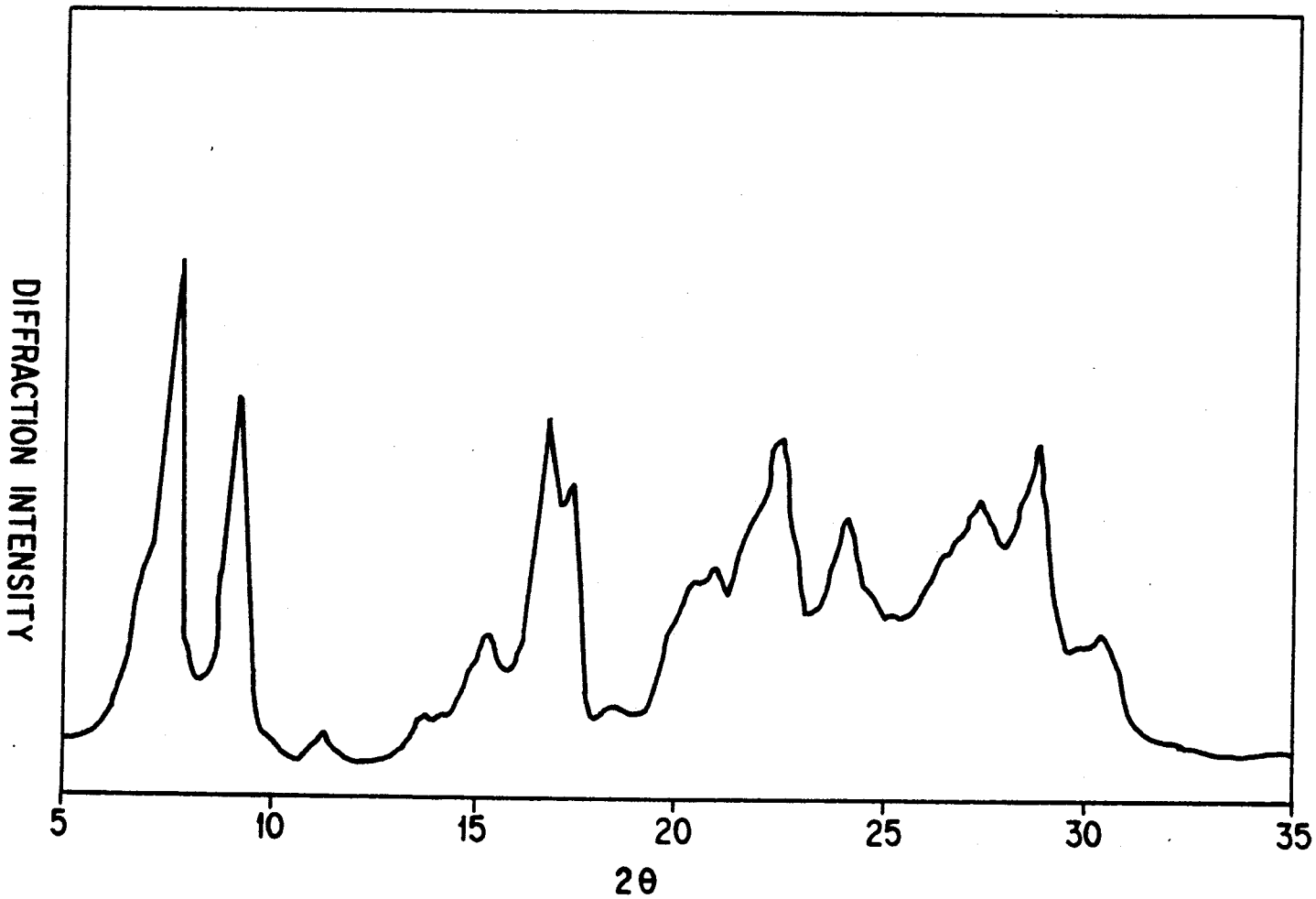
FIG. 1 is an X-ray diffraction diagram (CuK $\alpha$, powder method) of X-type nonmetal phthalocyanine used as a charge producing substance in the laminated organic photosensitive material of the invention.

FIG. 1 is an X-ray diffraction diagram (CuK $\alpha$, powder method) of the X-type nonmetal phthalocyanine.

The charge producing layer is formed with a mixture of a vinyl chloride-ethylene copolymer and a vinyl chloride-vinyl acetate-maleic acid copolymer as a binder resin. The vinyl chloride-ethylene copolymer used has preferably an ethylene content of about 3–10% and an average polymerization degree of about 400–1500.

The mixture of the resins as a binder resin for the charge producing layer is preferably composed of 40–95% by weight of vinyl chloride-ethylene copolymer and 5–60% by weight of vinyl chloride-vinyl acetate-maleic acid copolymer. When the amount of the vinyl chloride-vinyl acetate-maleic acid copolymer is less than 5% by weight in the mixture, the resultant binder resin has a small adhesive strength whereas when the amount is more than 60% by weight, the resultant laminated photosensitive material is not sufficiently electrified.

The smaller the content of the binder resin in the charge producing layer, the better, but it is usually ir the range of about 5–50% by weight based on the layer. The charge producing layer has a thickness usually of about 0.05–1 microns.

The organic solvent used in the preparation of the charge producing layer is such that the alcohol soluble polyamide resin is not soluble therein but the mixrure of the resins as the binder resin is soluble therein. Thus, the organic solvent used includes, for example, benzenc, toluene, xylene, methylene chloride, chloroform, 1,2-dichloroethane, 1,1,2,2-tetrachloroethane, chlorobenzene, dichlorobenzene, ethyl acetate, butyl acetate, methyl ethyl ketone, dioxane, tetrahydrofuran, cyclohexanone, methyl cellosolve or ethyl cellosolve.

The laminated organic photosensitive material of the invention has a charge transporting layer on the charge producing layer. The charge transporting layer contains a charge transporting substance. Any known charge transporting substance may be used, and there may be mentioned such an electron donating compound or a polymer as poly-N-vinylcarbazole, its derivatives, poly-$\tau$-carbazolyl-glutamate, its dervatives, pyrene-formaldehyde condensates, their derivatives, polyvinylpyrene, polyvinylphenanthrene, oxazole derivatives, oxadiazole derivatives, imidazole derivatives, 9-(p-diethylaminostyryl)anthracene, 1,1-bis(4-dibenzylaminophenyl)propane, styrylanthracene, styrylpyrazoline, arylamines, phenylhydrazones or $\alpha$-stilbene derivatives.

The binder resin for the charge transporting layer is of the type which is soluble in an organic solvent and is highly compatible with the charge transporting substance so that a stable solution thereof may be prepared easily. Moreover, it is preferable to use a resin which is inexpensive and can form a film of high mechanical strength, transparency and electrical insulation. The resin may be either thermoplatic or thermosetting, and may be, for example, polystyrene, styrene-acrylonitrile copolymer, styrene-butadiene copolymer, styrene-maleic anhydride copolymer, polyester resin, polyvinyl chloride, ethylene-vinyl chloride copolymer, vinyl chloride-vinyl acetate copolymer, ethylene-vinyl acetate-vinyl chloride copolymer, polyvinyl acetate, polyvinylidene chloride, polyallylate resin, phenoxy resin, polycarbonate, cellulose acetate resin, ethyl cellulose resin, polyvinyl butyral resin, polyvinyl formal resin, polyvinyl toluene, poly(N-vinyl carbazole) resin, acrylic resin, silicone resin, epoxy resin, melamine resin, urethane resin, phenol resin or alkyd resin.

The organic solvent used for the preparation of the change transporting layer is not specifically limited, but it may include, for example, tetrahydrofuran, dioxane, toluene, chlorobenzene, methylene chloride, chloroform. 1,2-dichloroethane or 1,1,2,2-tetrachloroethane.

The content of the charge transporting substance in the charge transporting layer is usually in the range of about 10–60% by weight based on the layer, and the thickness of the layer is usually in the range of about 5–100 microns.

The laminated organic photosensitive material of the invention is manufactured by applying an alcohol solution of the alcohol soluble polyamide resin onto the electroconductive support and drying to form an undercoat, applying a dispersion of a mixture of X-type nonmetal phthalocyanine as a charge producing substance, the mixture of the resins as a binder resin and, if necessary, a plasticizer, in an organic solvent onto the undercoat and drying to form a charge producing layer, and then applying a solution of a charge transporting substance, a binder resin and, if necessary a plasticizer, in an organic solvent, to form a charge transporting layer.

However, the laminated organic photosensitive material of the invention may have an electroconductive layer between the electroconductive support and the undercoat, or a protecting layer on the charge transporting layer, if necessary.

The laminated organic photosensitive material of the invention is readily and stably electrified, has a high photosensitivity, and has no high residual potential after repeated use, and in addition, it has a sufficient adhesive strength between the layers and of the photosensitive layer to the support, so that it provides copy images carrying no defects thereon.

Further, the photosensitive material of the invention has a high sensitivity to a semiconductor laser region wavelength and suitable for use as a photosentive material for a laser beam printer.

The invention will now be described more specifically with reference to examples, however, the invention is not limited thereto.

EXAMPLE 1

A solution of 20 parts by weight of alcohol soluble polyamide resin (nylon 6/66/610/12 copolymer, CM 8000 available from Toray K.K.) in 313 parts by weight of methanol was applied onto the outer surface of an aluminum cylinder of 30 mm in outer diameter and dried at 90° C. for one hour to form an undercoat of 1 micron in thickness.

A mixture of 2.0 parts by weight of vinyl chloride-ethylene copolymer having an ethylene content of 8% and an average polymerization degree of 1050 (VE-U available from Tokuyama Sekisui Kogyo K.K.), 0.2 parts by weight of a vinyl chloride-vinyl acetate-maleic acid copolymer composed of 86% by weight of vinyl chloride component 13% by weight of vinyl acetate component and 1% by weight of maleic acid and having an average polymerization degree of about 420 (Esleck M availalble from Sekisui Kagaku Kogyo K.K.), 3 parts by weight of X-type nonmetal phthalocyanine and 200 parts by weight of tetrahydrofuran was pulverized with a ball mill for two hours to prepare a suspension. The X-ray diffraction diagram (CuK $\alpha$, powder method) of the X-type nonmetal phthalocyanine used is shown in FIG. 1.

The dispersion was applied onto the undercoat, dried at 90° C. for 30 minutes to form a charge producing layer of 0.5 microns in thickness.

A solution of 130 parts by weight of polycarbonate (Yupiron E-2000 available from Mitsubishi Gas Kagaku Kogyo K.K.) and 104 parts by weight of a charge transporting substance represented by the formula:

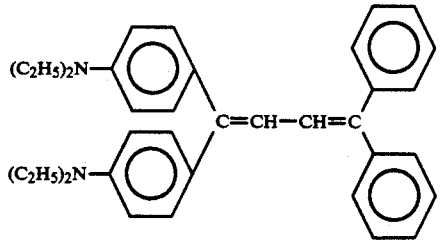

in 1004 parts by weight of 1,2-dichloroethane was applied onto the charge producing layer and heated gradually to a temperature of 110° C. at a rate of 1° C. per minute in the range of 60°-100° C., to form a charge transporting layer, whereby a laminated organic photosensitive material was obtained.

EXAMPLE 2

A laminated photosensitive material was prepared in the same manner as in the Example 1 using a dispersion of 1.83 parts by weight of vinyl chloride-ethylene copolymer, 0.37 parts by weight of vinyl chloride-vinyl acetate-maleic acid copolymer and 3 parts by weight of X-type nonmetal phthalocyanine, all the materials being the same as those in the Example 1, in 200 parts by weight of tetrahydrofuran to prepare a charge producing layer.

EXAMPLE 3

A laminated photosensitive material was prepared in the same manner as in the Example 1 using a dispersion of 1.1 parts by weight of vinyl chloride-ethylene copolymer, 1.1 parts by weight of vinyl chloride-vinyl acetate-maleic acid copolymer and 3 parts by weight of X-type nonmetal phthalocyanine, all the materials being the same as those in the Example 1, in 200 parts by weight of tetrohydrofuran to prepare a charge producing layer.

COMPARATIVE EXAMPLE 1

A laminated photosensitive material was prepared in the same manner as in the Example 1 using only the same vinyl chloride-ethylene copolymer as in the Example 1 as a binder resin for the charge producing layer.

COMPARATIVE EXAMPLE 2

A laminated photosensitive material was prepared in the same manner as in the Example 1 using only the same vinyl chloride-vinyl acetate-maleic acid copolymer as in the Example 1 as a binder resin for the charge producing layer.

COMPARATIVE EXAMPLE 3

A laminated photosensitive material was prepared in the same manner as in the Example 1 using only a polyvinyl chloride resin (Zeon 121 available from Nippon Zeon K.K.) as a binder resin for the charge producing layer.

COMPARATIVE EXAMPLE 4

A laminated photosensitive material was prepared in the same manner as in the Example 1 using only an ethylene-vinyl acetate-vinyl chloride copolymer (Graftmer R-5 available from Nippon Zeon K.K.) as a binder resin for the charge producing layer.

COMPARATIVE EXAMPLE 5

A laminated photosensitive material was prepared in the same manner as in the Example 1 using an aqueous solution of 20 parts by weight of polyvinyl alcohol (Gosenol NH-26 available from Nippn Gosei Kagaku Kogyo K.K.) in 48 parts by weight of water to form an undercoat.

COMPARATIVE EXAMPLE 6

A laminated photosensitive material was prepared in the same manner as in the Example 1 except that an undercoat was not formed.

COMPARATIVE EXAMPLE 7

A laminated photosensitive material was prepared in the same manner as in the Example 1 except that titanyl phthalocyanine was used in place of the X-type nonmetal phthalocyanine as a charge producing substance.

Figure 2:
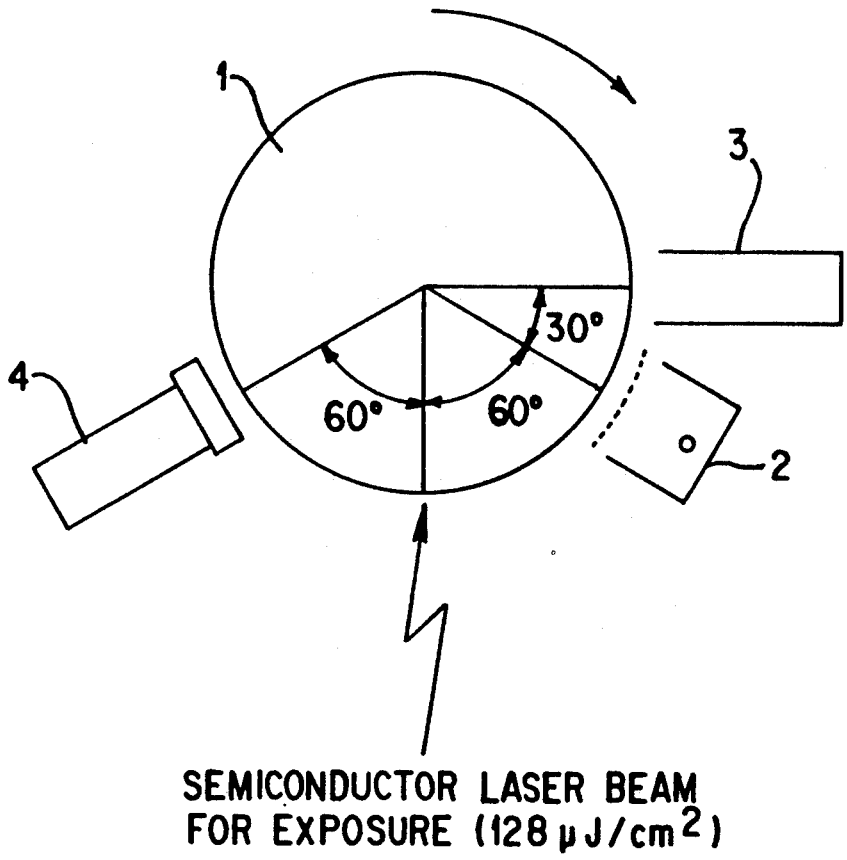
FIG. 2 is a schematic view showing an apparatus to evaluate the properties of a laminated organic photosensitive material.

The laminated photosensitive materials prepared as above set forth were each evaluated for electrostatic charging characteristics by use of an electrostatic charging testing device to measure surface potential at an area corresponding to a developing portion of an actual laser beam printer, as illustrated in FIG. 2.

First the surface of a photosensitive drum 1 was negatively charged at −650 V with a corona discharger 2 while the photosensitive drum was rotated at a rate of 41 rpm, and then the surface was irradiated with an LED 3 whereupon the potential of the surface of the drum was measured with a probe 4 which located correspondingly to the developing portion as the initial potential $V_o$.

Then the surface of the photosensitive drum was irradiated for 10 minutes with a semiconductor laser having a wavelength of 780 nm and an intensity of 1.28 $\mu J/cm^2$ whereupon the surface potential was measured as the residual potantial $V_R$. The results are shown in Table 1.

The copying performance was also evaluated. The photosensitive drum was fitted to a reversed developing photoprinter (F1000+ available from Kyocera K.K.) and copies were made therewith to examine whether dark spots or lines appeared on the copy images. The results are shown in Table 1.

The adhesion between the undercoat and the charge producing layer was tested. The results are shown in Table 1.

It was also found that there took place no reduction in darkness of copy images after making 1000 sheets of copies with the same photoprinter as above fitted with the photosensitive drums manufactured in the Examples 1,2 and 3, respectively.

TABLE 1

| | Resin of Undercoat[1)] | Charge Producing Substance[2)] | Binder Resin for Charge Producing Layer[3)] (Weight Ratio) | Initial Potential $V_o$ (volt) | Residual Potential $V_R$ (volt) | Defects on Copy Images | Adhesion of Undercoat |
|---|---|---|---|---|---|---|---|
| Example | | | | | | | |
| 1 | A | X | VC-VAc-MA/VC-Et (1/10) | −550 | −22 | None | Excellent |
| 2 | A | X | VC-VAc-MA/VC-Et (1/5) | −540 | −20 | None | Excellent |
| 3 | A | X | VC-VAc-MA/VC-Et (1/1) | −535 | −17 | None | Excellent |
| Comparative | | | | | | | |
| 1 | A | X | VC-Et | −540 | −60 | None | Bad |
| 2 | A | X | VC-VAc-MA | −480 | −22 | None | Excellent |
| 3 | A | X | PVC | −510 | −112 | None | Bad |
| 4 | A | X | Et-VAc-VC | −560 | −125 | None | Bad |
| 5 | PVA | X | VC-VAc-MA/VC-Et (1/10) | −535 | −22 | Many | Excellent |
| 6 | none | X | Vc-VAc-MA/VC-Et (1/10) | −510 | −15 | Very Much | — |
| 7 | A | T | Vc-VAc-MA/VC-Et (1/10) | −460 | −8 | None | Excellent |

Notes:
[1)]A: Alcohol soluble polyamide resin PVA: Polyvinyl alcohol
[2)]X: X-type nonmetal phthalocyanine T: Titanyl phthalocyanine
[3)]VC-VAc-MA: Vinyl chloride-vinyl acetate-maleic acid copolymer VC-Et: Vinyl chloride-ethlyene copolymer PVC: Polyvinyl chloride Et-VAc-VC: Ethylene-vinyl acetate-vinyl chloride copolymer When an undercoat was formed with polyvinyl alcohol (Comparative Example 5) and when an undercoat was not formed (Comparative Example 6), the resultant copy images were found to have a number of defects. When titanyl phthalocyanine was used as a charge producing substance, (Comparative Example 7), the resultant photosensitive drum was found to be very poorly electrified.

When polyvinyl chloride or ethylene-vinyl acetate-vinyl chloride copolymer only was used as a binder resin (Comparative Examples 3 and 4), the resultant photosensitive materials were found to have a high residual potential, and also a poor adhesion of the charge producing layer to the undercoat.

When polyvinyl chloride-ethylene copolymer only was used as a binder resin for the charge producing layer (Comparative Example 1), the resultant photosensitive material was also found to have a high residual potential, as well as a poor adhesion of the charge producing layer to the undercoat, while when vinyl chloride-vinyl acetate-maleic acid copolymer only was used as a binder resin for the charge producing layer (Comparative Example 2), the resultant photosensitive material was found to be very poorly electrified.

In contrast to these photosensitive materials of the Comparative Examples, those of the invention are readily and stably electrified, have a low residual potential, and an improved adhesive strength between the undercoat and the charge producing layer. Consequently the photosensitive material of the invention provides copy images with no defects.

What is claimed is:

1. A laminated organic photosensitive material which comprises an electroconductive support, an undercoat formed on the electroconductive support, a charge producing layer provided on the undercoat and a charge transporting layer provided on the charge producing layer wherein the undercoat comprises an alcohol soluble polyamide resin and wherein the charge producing layer comprises (a) an X-type nonmetal phthalocyanine, as a charge producing substance, and (b) a mixture of a vinyl chloride-ethylene copolymer, in an amount of 40–95% by weight, based on the mixture, and a vinyl chloride-vinyl acetate-maleic acid copolymer, in an amount of 5–60% by weight, based on the mixture, as a binder resin for the charge producing layer.

2. The laminated organic photosensitive material as claimed in claim 1 wherein the alcohol soluble polyamide resin is a nylon copolymer.

3. The laminated organic photosensitive material as claimed in claim 1 wherein the nylon copolymer is nylon 6/66.

4. The laminated organic photosensitive material as claimed in claim 1 wherein the nylon copolymer is nylon 6/66/610.

5. The laminated organic photosensitive material as claimed in claim 1 wherein the nylon copolymer is nylon 6/66/610/12.

6. The laminated organic photosensitive material as claimed in claim 1 wherein the alcohol soluble polyamide resin is soluble in methanol, ethanol or propanol.

7. The laminated organic photosensitive material as claimed in claim 1 wherein the undercoat has a thickness of 0.3–5 microns.

8. The laminated organic photosensitive material as claimed in claim 1 wherein the vinyl chloride-ethylene copolymer has an ethylene content of 3–10% and an average polymerization degree of 400–1500.

9. The laminated organic photosensitive material as claimed in claim 1 wherein the charge transporting layer contains the binder resin in an amount of 5–50% by weight based on the layer.

10. The laminated organic photosensitive material as claimed in claim 1 wherein the charge transporting layer has a thickness of 0.05–1 micron.

11. The laminated organic photosensitive material as claimed in claim 1 wherein the charge transporting layer has a thickness of 5–100 microns.

* * * * *